US010585373B2

(12) United States Patent
Sano et al.

(10) Patent No.: US 10,585,373 B2
(45) Date of Patent: Mar. 10, 2020

(54) IMAGE FORMING APPARATUS CAPABLE OF APPLYING APPROPRIATE VOLTAGE TO DEVELOPING ROLLER IRRESPECTIVE OF DEVIATION IN PRESSING FORCE OF PRESSING MEMBER

(71) Applicant: BROTHER KOGYO KABUSHIKI KAISHA, Nagoya-shi, Aichi-ken (JP)

(72) Inventors: Toshiyuki Sano, Aichi-ken (JP); Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/288,825

(22) Filed: Feb. 28, 2019

(65) Prior Publication Data

US 2019/0302640 A1 Oct. 3, 2019

(30) Foreign Application Priority Data

Mar. 29, 2018 (JP) ..... 2018-063385

(51) Int. Cl.
*G03G 15/06* (2006.01)
*G03G 15/08* (2006.01)
*G03G 21/18* (2006.01)

(52) U.S. Cl.
CPC ..... *G03G 15/065* (2013.01); *G03G 15/0813* (2013.01); *G03G 15/0863* (2013.01);
(Continued)

(58) Field of Classification Search
CPC ..... G03G 15/065; G03G 15/0863; G03G 15/0813; G03G 15/0896;
(Continued)

(56) References Cited

U.S. PATENT DOCUMENTS 6,070,022 A 5/2000 Kobayashi et al.
2005/0141909 A1* 6/2005 Takahashi ..... G03G 15/065 399/53

(Continued)

FOREIGN PATENT DOCUMENTS

JP 01131576 A * 5/1989 ..... G03G 15/0896
JP 10-39723 A 2/1998
JP 2010-128336 A 6/2010

*Primary Examiner* — David M. Gray
*Assistant Examiner* — Laura Roth
(74) *Attorney, Agent, or Firm* — Merchant & Gould P.C.

(57) ABSTRACT

An image forming apparatus includes: a casing; a toner cartridge; a drum cartridge; a main electrode; a first reading portion; and a controller. The toner cartridge is attachable to the drum cartridge and includes: a developing roller; and a developing electrode electrically connected to the developing roller. The drum cartridge is attachable to the casing and includes: a photosensitive drum; a pressing member; and a drum memory. The pressing member presses the toner cartridge toward the photosensitive drum so that an outer circumferential surface of the developing roller contacts an outer circumferential surface of the photosensitive drum. The drum memory stores a pressing force value indicating a pressing force to be applied by the pressing member. The controller is configured to perform: reading, through the first reading portion, the pressing force value from the drum memory; and applying a voltage to the main electrode based on the pressing force value.

18 Claims, 6 Drawing Sheets

(52) U.S. Cl.
CPC ..... *G03G 21/1875* (2013.01); *G03G 21/1878* (2013.01); *G03G 21/1889* (2013.01); *G03G 21/1867* (2013.01); *G03G 2215/0673* (2013.01); *G03G 2221/1684* (2013.01); *G03G 2221/1823* (2013.01); *G03G 2221/1869* (2013.01)

(58) Field of Classification Search
CPC ... G03G 2221/1869; G03G 2221/1684; G03G 2221/1823; G03G 15/087; G03G 21/1867; G03G 21/1875; G03G 21/1878; G03G 21/1889; G03G 2215/0673
See application file for complete search history.

(56) References Cited

U.S. PATENT DOCUMENTS

| | | | | |
|---|---|---|---|---|
| 2010/0135693 | A1 | 6/2010 | Okabe et al. | |
| 2019/0033754 | A1* | 1/2019 | Porat ..... | G03G 15/104 |

* cited by examiner

| | POLYMERIZED TONER | PULVERIZED TONER |
|---|---|---|
| PRESSING FORCE VALUE N | DEVELOPING BIAS V1 | DEVELOPING BIAS V2 |

IMAGE FORMING APPARATUS CAPABLE OF APPLYING APPROPRIATE VOLTAGE TO DEVELOPING ROLLER IRRESPECTIVE OF DEVIATION IN PRESSING FORCE OF PRESSING MEMBER

CROSS REFERENCE TO RELATED APPLICATION

This application claims priority from Japanese Patent Application No. 2018-063385 filed Mar. 29, 2018. The entire content of the priority application is incorporated herein by reference.

TECHNICAL FIELD

The present disclosure relates to an image forming apparatus.

BACKGROUND

An electro-photographic type image forming apparatus such as a laser printer and an LED printer is well known in the art. In such an image forming apparatus, a process cartridge in which a toner cartridge is attached to a drum cartridge is attached to a main body of the image forming apparatus.

SUMMARY

Prior art describes an image forming apparatus that includes a toner cartridge and a drum cartridge that can be separated from each other. With such image forming apparatus, the toner cartridge and the drum cartridge are separately manufactured and then shipped from a factory. Hence, the toner cartridge and the drum cartridge may have deviations in characteristics thereof, and as a result, various adjustments during execution of a printing operations may be difficult. In particular, when the toner cartridge includes a developing roller and the drum cartridge includes a photosensitive drum and a pressing member, the pressing member presses the developing roller toward the photosensitive drum with a pressing force in a state where the toner cartridge is attached to the drum cartridge. This pressing force of the pressing member may have deviation depending on deviation of the pressing member.

In view of the foregoing, it is an object of the present disclosure to provide an image forming apparatus capable of performing various adjustments during printing operations by applying an appropriate voltage to a developing roller even when a pressing force applied to the developing roller by the pressing member varies.

In order to attain the above and other objects, the disclosure provides an image forming apparatus including: a casing; a toner cartridge; a drum cartridge to which the toner cartridge is attachable; a main electrode; a first reading portion; and a controller. The toner cartridge includes: a developing roller; and a developing electrode. The developing roller has an outer circumferential surface. The developing electrode is electrically connected to the developing roller. The drum cartridge is attachable to the casing in a state where the toner cartridge is attached to the drum cartridge. The drum cartridge includes: a photosensitive drum; a pressing member; and a drum memory. The photosensitive drum has an outer circumferential surface. The pressing member is configured to press the toner cartridge toward the photosensitive drum with a pressing force in the state where the toner cartridge is attached to the drum cartridge so that the outer circumferential surface of the developing roller is in contact with the outer circumferential surface of the photosensitive drum. The drum memory stores therein information representing a pressing force value. The pressing force value is a value indicative of the pressing force to be applied by the pressing member. The main electrode is electrically connected to the developing electrode in a state where the drum cartridge to which the toner cartridge is attached is attached to the casing. The first reading portion is electrically connected to the drum memory in the state where the drum cartridge to which the toner cartridge is attached is attached to the casing. The information stored in the drum memory is read from the drum memory through the first reading portion. The controller is configured to perform: (a) reading, through the first reading portion, the pressing force value from the drum memory; and (b) applying a voltage to the main electrode based on the pressing force value read in the (a) reading.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, an image forming apparatus 100 according to one embodiment of the present disclosure will be described with reference to FIGS. 1 through 7.

<1. Configuration of Image Forming Apparatus>

Figure 1:
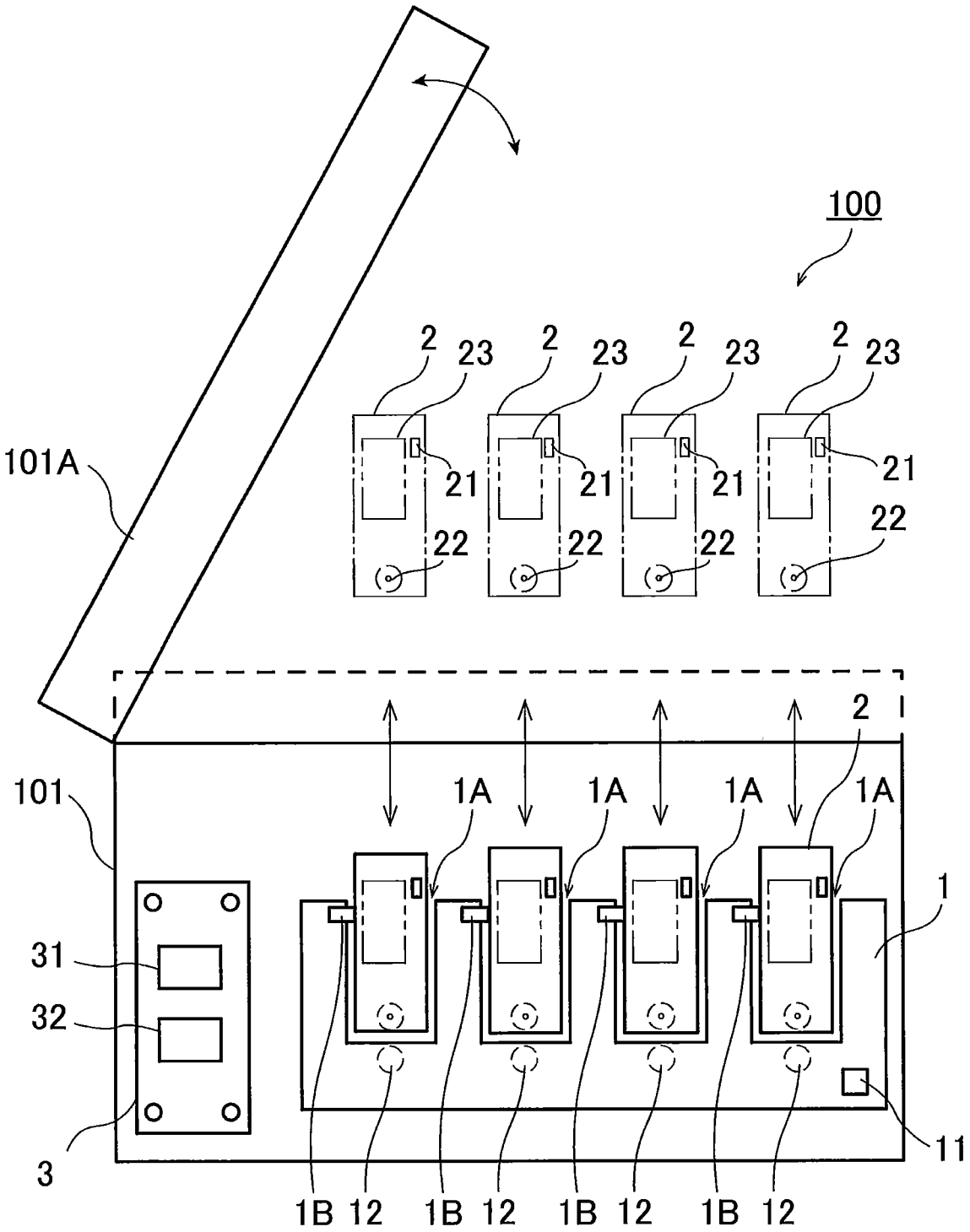
FIG. 1 is a schematic diagram of an image forming apparatus according to one embodiment of the present disclosure.
Figures 2, 3:
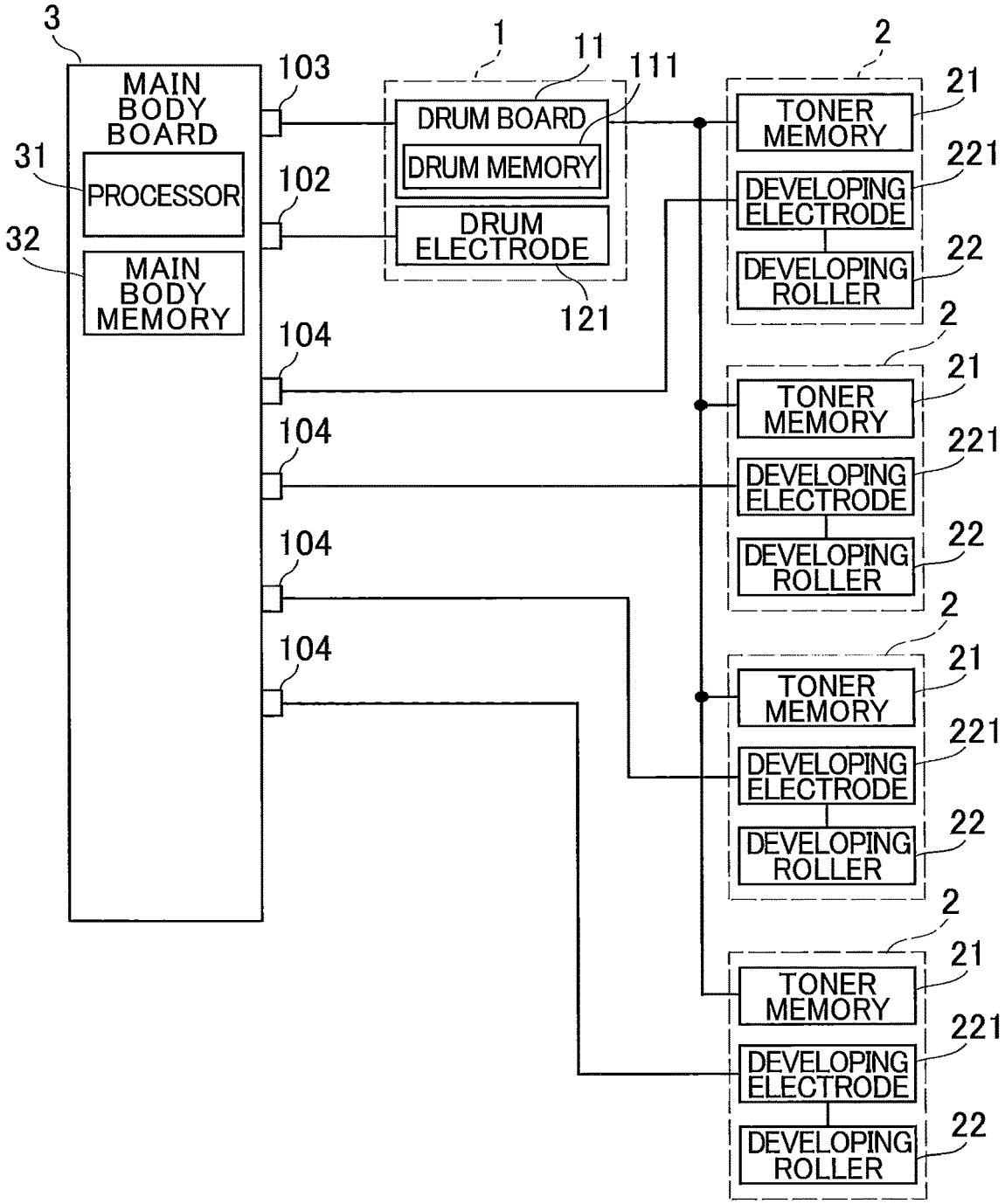
FIG. 2 is a block diagram illustrating electrical connection among components in the image forming apparatus according to the embodiment.
FIG. 3 is an explanatory view of a pressing force value and developing bias values correlated thereto stored in a drum memory of a drum cartridge in the image forming apparatus according to the embodiment.

FIG. 1 is a schematic diagram of the image forming apparatus 100. FIG. 2 is a diagram illustrating electrical connection among components in the image forming apparatus 100.

The image forming apparatus 100 is an electro-photographic type printer. For example, the image forming apparatus 100 may be a laser printer or an LED printer. As illustrated in FIG. 1, the image forming apparatus 100 includes a main body casing 101 as an example of a casing, a main body board 3, a drum cartridge 1, and a plurality of toner cartridges 2.

The main body casing 101 accommodates therein the main body board 3, the drum cartridge 1, and the plurality of toner cartridges 2. The plurality of toner cartridges 2 is attachable to the main body casing 101 in a state where the plurality of toner cartridges 2 is attached to the drum cartridge 1. The main body casing 101 includes a cover 101A movable between an open position and a closed position. By opening the cover 101A, the main body casing 101 can receive the drum cartridge 1 to which the plurality of toner cartridges 2 is attached.

The drum cartridge 1 includes four slots 1A. Each of the four slots 1A is configured to receive the corresponding one of the plurality of toner cartridges 2. Further, the drum cartridge 1 includes a plurality of pressing members 1B and a plurality of photosensitive drums 12. Each of the plurality of pressing members 1B and each of the plurality of photosensitive drums 12 are provided at corresponding one of slots 1A.

When each toner cartridge 2 is inserted into the corresponding slot 1A, an outer circumferential surface of a developing roller 22 of each toner cartridge 2 faces an outer circumferential surface of the photosensitive drum 12 provided at the corresponding slot 1A. Each of the pressing members 1B includes, for example, a spring. By making use of an elastic force of the spring, the pressing member 1B presses the toner cartridge 2 inserted into the slot 1A toward the corresponding photosensitive drum 12, thereby bringing the outer circumferential surface of the developing roller 22 and the outer circumferential surface of the photosensitive drum 12 into contact with each other.

Each of the photosensitive drums 12 is configured to transfer toner onto a sheet of paper. A drum electrode 121 is electrically connected to each of the photosensitive drum 12. The drum electrode 121 is provided at, for example, a bearing of the photosensitive drum 12. In a state where the drum cartridge 1 is attached to the main body casing 101, the drum electrode 121 is electrically connected to a main body electrode 102 provided within the main body casing 101. By applying a voltage (hereinafter referred to as "supply bias") to the main body electrode 102, the supply bias is applied to the photosensitive drum 12 through the drum electrode 121.

The drum cartridge 1 further includes a drum electrical board 11. As illustrated in FIG. 2, the drum electrical board 11 includes a drum memory 111. The drum memory 111 is a storage medium from which information is readable and to which information is writable. The drum memory 111 may be any type of memory such as a flash ROM or an EEPROM as long as data can be read from the memory, data can be written into the memory, and data can be deleted from the memory.

The drum memory 111 stores therein various information (hereinafter "drum information"). The drum information at least includes a pressing force value indicating a pressing force applied by each of the pressing members 1B. The drum information also includes at least one bias voltage associated with the pressing force value. This bias voltage (hereinafter referred to as "developing bias") is applied to each of the developing rollers 22. The pressing force value and the developing bias will be described later. The developing bias is an example of a force-dependent bias voltage.

The drum information stored in the drum memory 111 may include identification information relating to the drum cartridge 1, a specification of the drum cartridge 1, a service life of each photosensitive drum 12, charging characteristics of each photosensitive drums 12, accumulated rotation amount of each photosensitive drum 12, accumulated charged time of each photosensitive drum 12, the number of sheets that have been printed, and an error history.

Upon completion of attachment of the drum cartridge 1 to the main body casing 101, the drum electrical board 11 is brought into electrical connection to a terminal 103 provided in the main body casing 101. The drum electrical board 11 is electrically connected to the main body board 3 through the terminal 103. Accordingly, the drum electrical board 11 is capable of communicating with the main body board 3, thereby allowing the main body board 3 to read the drum information stored in the drum memory 111. The terminal 103 is an example of a first reading portion.

As illustrated in FIGS. 1 and 2, each of the plurality of toner cartridges 2 includes a toner memory 21, the developing roller 22, and an accommodating portion 23.

Each of the accommodating portions 23 accommodates toner (developer) therein. The accommodating portions 23 of the toner cartridges 2 accommodate toner of colors different from each other (such as cyan, magenta, yellow, and black). Note that the accommodating portions 23 may accommodate toner of the same color.

The image forming apparatus 100 is configured to form an image on a recording surface of a printing sheet using toner supplied from the plurality of toner cartridges 2. In the present embodiment, the number of the toner cartridges 2 attachable to the drum cartridge 1 is four. However, the number of the toner cartridges 2 attachable to the drum cartridge 1 may be one to three, or more than five.

The toner memory 21 is a storage medium to which information is writable and from which information is readable. Any types of memory such as a flash ROM or an EEPROM can be used as the toner memory 21 provided that data can be read from the memory, data can be written into the memory, and data can be deleted from the memory. The toner memory 21 stores therein toner information including at least identification information used to identify a toner cartridge 2 (hereinafter referred to as "toner ID"). The toner information stored in the toner memory 21 may include, for example, information relating to color of accommodated toner, a service life of the developing roller 22, accumulated rotation amount of the developing roller 22, an amount of toner that has been used, and an error history related to the toner cartridge 2.

In a state where each of the toner cartridges 2 is attached to the drum cartridge 1, each of the toner memories 21 is electrically connected to the drum electrical board 11. As described above, in a state where drum cartridge 1 is attached to into the main body casing 101, the drum electrical board 11 is electrically connected to the main body board 3 through the terminal 103. That is, each of the toner memories 21 is electrically connected to the main body board 3 through the drum electrical board 11, thereby enabling each of the toner memories 21 and the main body board 3 to communicate with each other.

The main body board 3 is configured to read the toner information stored in each of the toner memories 21 through the drum electrical board 11. As the main body board 3 reads the toner ID from the toner memories 21, the main body board 3 identifies types of toner accommodated in the accommodating portions 23 of the respective toner cartridges 2. Polymerized toner and pulverized toner are examples of the type of toner. The terminal 103 is an example of a second reading portion. Note that each of the toner memories 21 may be connected to the main body board 3 without interposing the drum electrical board 11 therebetween.

The developing roller 22 is configured to supply toner accommodated in the accommodating portion 23 to the outer circumferential surface of the photosensitive drum 12. In a state where the toner cartridge 2 is attached to the drum cartridge 1, the outer circumferential surface of the developing roller 22 and the outer circumferential surface of the photosensitive drum 12 are in contact with each other. A developing electrode 221 is electrically connected to the developing roller 22 of each of the toner cartridges 2. The developing electrode 221 serves as, for example, a bearing of the developing roller 22.

When the drum cartridge 1 to which each of the toner cartridges 2 is attached is attached to the main body casing 101, each of the developing electrodes 221 is electrically connected to corresponding one of main body electrodes 104 provided in the main body casing 101. A processor 31 of the main body board 3 controls an operation to apply a developing bias to each main body electrode 104, thereby applying the developing bias to the corresponding developing roller 22 via the developing electrode 221. Meanwhile, a supply bias is applied to each of the photosensitive drums 12 as described above. Accordingly, toner is supplied from the developing roller 22 to the photosensitive drum 12 due to a potential difference between the supply bias applied to the photosensitive drum 12 and the developing bias applied to the developing roller 22.

The main body board 3 includes a circuit board (not illustrated), the processor 31 such as a CPU, and a main body memory 32 serving as a storage medium, for example. Any types of memory such as a flash ROM, an EEPROM, or an EPROM can be employed as the main body memory 32 as long as data can be read from the memory, data can be written into the memory, and data can be deleted from the memory.

The processor 31 is a controller configured to operate in accordance with programs stored in the main body memory 32 to execute various processes in the image forming apparatus 100. For example, the processor 31 is configured to execute a reading process, a voltage-applying process, and a correcting process. The processor 31 is an example of a controller.

The reading process is a process for reading the drum information from the drum memory 111 and for reading the toner information from each toner memory 21. The voltage-applying process is a process for applying a developing bias through the main body electrodes 104 to the developing electrodes 221, i.e., the developing rollers 22. The voltage-applying process is also a process for applying a supply bias to the drum electrode 121, i.e., the photosensitive drums 12 through the main body electrode 102. The correcting process is a process for correcting a service life of the toner cartridges 2. Detailed descriptions as to the above processes will be made later.

<2. Pressing Force Value Stored in Drum Memory>

Hereinafter, the pressing force value stored in the drum memory 111 and the developing bias value associated with this pressing force value will be described.

FIG. 3 is an explanatory view of the pressing force value stored in the drum memory 111 and developing bias values correlated thereto.

The drum memory 111 stores therein a pressing force value N indicative of the pressing force applied by the pressing member 1B, and developing biases V1 and V2 corresponding to the pressing force value N. When the type of toner is polymerized toner, the developing bias V1 is correlated to the pressing force value N. When the type of toner is pulverized toner, the developing bias V2 is correlated to the pressing force value N. That is, the drum memory 111 stores a developing bias for each type of toner.

As the toner cartridge 2 is attached to the slot 1A of the drum cartridge 1, the toner cartridge 2 is pressed by the pressing member 1B. The developing roller 22 is urged toward the photosensitive drum 12 due to a pressing force applied by the pressing member 1B. Accordingly, a contact pressure between the developing roller 22 and the photosensitive drum 12 varies depending on the pressing force applied by the pressing member 1B.

In accordance with variation of the contact pressure between the developing roller 22 and the photosensitive drum 12, the potential difference between the developing bias and the supply bias needs be adjusted in order to supply toner from the developing roller 22 to the photosensitive drum 12. To this end, as illustrated in FIG. 3, the drum memory 111 stores therein values of the developing biases correlated to the pressing force value applied by the pressing member 1B.

Further, the potential difference between the developing bias and the supply bias also needs be changed depending on the type of toner. Since the pulverized toner has particles more irregular in size and shape than particles of the polymerized toner, it is likely that variation in electrical characteristics of the pulverized toner may occur when the pulverized toner is transferred from the developing roller 22 to the photosensitive drum 12. Thus, when the pulverized toner is used, the potential difference between the developing bias and the supply bias needs be greater than a potential difference required when the polymerized toner is used. Accordingly, the drum memory 111 stores therein developing biases correlated to the pressing force value of the pressing member 1B for each of types of toner, as illustrated in FIG. 3.

The processor 31 reads the toner ID stored in the toner memory 21 from the toner memory 21 to identify the type of toner accommodated in the accommodating portion 23. The processor 31 also reads the information illustrated in FIG. 3 from the drum memory 111. The processor 31 acquires a developing bias value depending on the type of toner in the toner cartridge 2 attached to the drum cartridge 1 and the pressing force value of the pressing member 1B of the drum cartridge 1. Then, a developing bias based on the acquired developing bias value is applied to the developing roller 22 in a printing process.

<3. Processes Executed After Attachment of Drum Cartridge>

Figure 4:
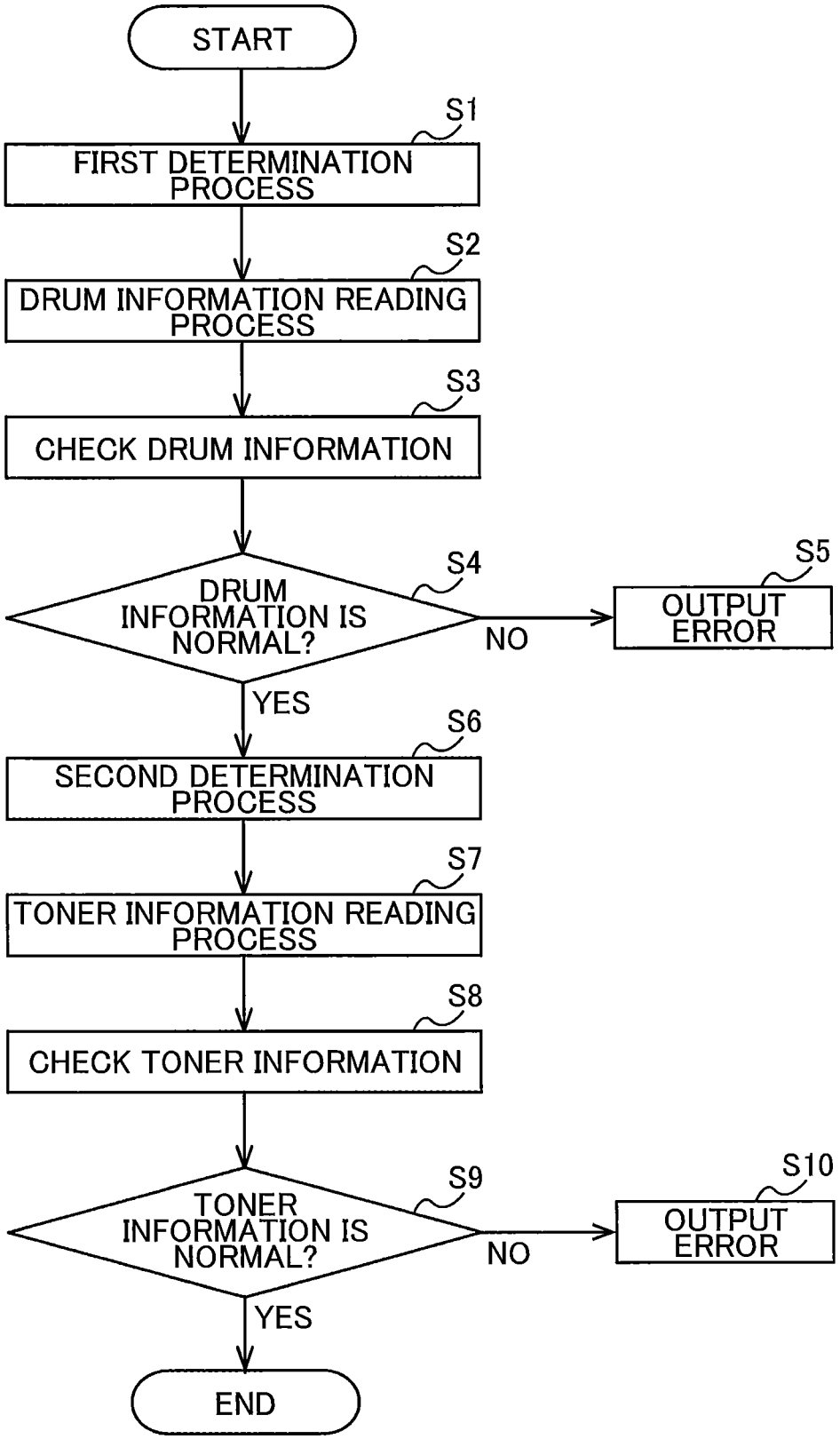
FIG. 4 is a flowchart illustrating steps in a process executed by a processor of the image forming apparatus according to the embodiment, the process being executed after a cover of the image forming apparatus is closed.

Next, processes executed by the processor 31 after the drum cartridge 1 is attached to the main body casing 101 of the image forming apparatus 100 will be described in detail. FIG. 4 is a flowchart illustrating steps in the processes executed after the cover 101A has been closed.

When the cover 101A of the main body casing 101 has been closed in a state where the drum cartridge 1 is attached to the main body casing 101, in S1 the processor 31 first executes a first determination process. In the first determination process, the processor 31 determines whether communication with the drum memory 111 has been established, and performs authentication of the drum memory 111.

When the processor 31 determines that the communication with the drum memory 111 is established and the drum memory 111 is authenticated, in S2 the processor 31 executes a reading process to read the drum information stored in the drum memory 111. The drum information read in S2 includes at least the pressing force value illustrated in FIG. 3 and developing biases correlated to this pressing force value.

In addition, the drum information read in S2 includes at least one of: a manufacturing serial number of the drum cartridge 1; identification information indicating that the drum cartridge 1 is a genuine product; information indicating models to which the drum cartridge 1 is applicable; a specification of the drum cartridge 1; a service life of each photosensitive drum 12; charging characteristics of each photosensitive drum 12; information indicating whether the drum cartridge 1 is new; the cumulative rotation amount of each photosensitive drum 12; the cumulative charged time of each photosensitive drum 12; the number of sheets that have been printed; and the error history.

Then, in S3 the processor 31 checks the drum information read from the drum memory 111, and subsequently in S4 the processor 31 determines whether the drum information read from the drum memory 111 is normal. Specifically, the processor 31 determines whether the drum information read from the drum memory 111 satisfies a prescribed condition.

When the drum information read from the drum memory 111 does not satisfy the prescribed condition (S4: NO), the processor 31 determines that the read drum information is not normal. In this case, in S5 the processor 31 outputs an error. For example, the processor 31 reads drum error message information stored in the main body memory 32, and displays an error message on a display (not illustrated) based on the read drum error message information.

On the other hand, when the drum information read from the drum memory 111 satisfies the prescribed condition (S4: YES), the processor 31 determines that the drum information is normal. In this case, in S6 the processor 31 executes a second determination process. In the second determination process, the processor 31 determines whether communication with the toner memory 21 has been established, and performs authentication of the toner memory 21.

When the processor 31 determines that the communication with the toner memory 21 is established and the toner memory 21 is successfully authenticated, in S7 the processor 31 executes a reading process for reading the toner information stored in the toner memory 21. The toner information read in S7 includes, for example, at least the toner ID described above.

In addition, the toner information read in S7 includes at least one of: a manufacturing serial number of the toner cartridge 2; identification information indicating that the toner cartridge 2 is a genuine product; information indicating models to which the toner cartridge 2 is applicable; specifications of the toner cartridge 2, an amount of toner accommodated in the accommodating portion 23; a service life of the toner cartridge 2; information indicating whether the toner cartridge 2 is new; the cumulative rotation amount of the developing roller 22, the number of sheets that have been printed; and an error history.

In S8, the processor 31 checks the toner information read from the toner memory 21, and in S9 the processor 31 determines whether the toner information read from the toner memory 21 is normal. Specifically, the processor 31 determines whether the toner information read from the toner memory 21 satisfies a prescribed condition.

When the toner information read from the toner memory 21 does not satisfy the prescribed condition (S9: NO), the processor 31 determines that the toner information is not normal. In this case, in S10 the processor 31 outputs an error. Specifically, for example, the processor 31 reads toner error message information stored in the main body memory 32, and then displays an error message on the display (not illustrated) on a basis of the read toner error message information.

On the other hand, when the toner information read from the toner memory 21 satisfies the prescribed condition (S9: YES), the processor 31 determines that the toner information is normal. In this case, the processor 31 ends the processes illustrated in FIG. 4 and enters a stand-by state in which the processor 31 waits for a print command to be inputted.

The processes in S6 to S10 are executed for each of the toner memories 21 of the plurality of toner cartridges 2.

Figure 5:
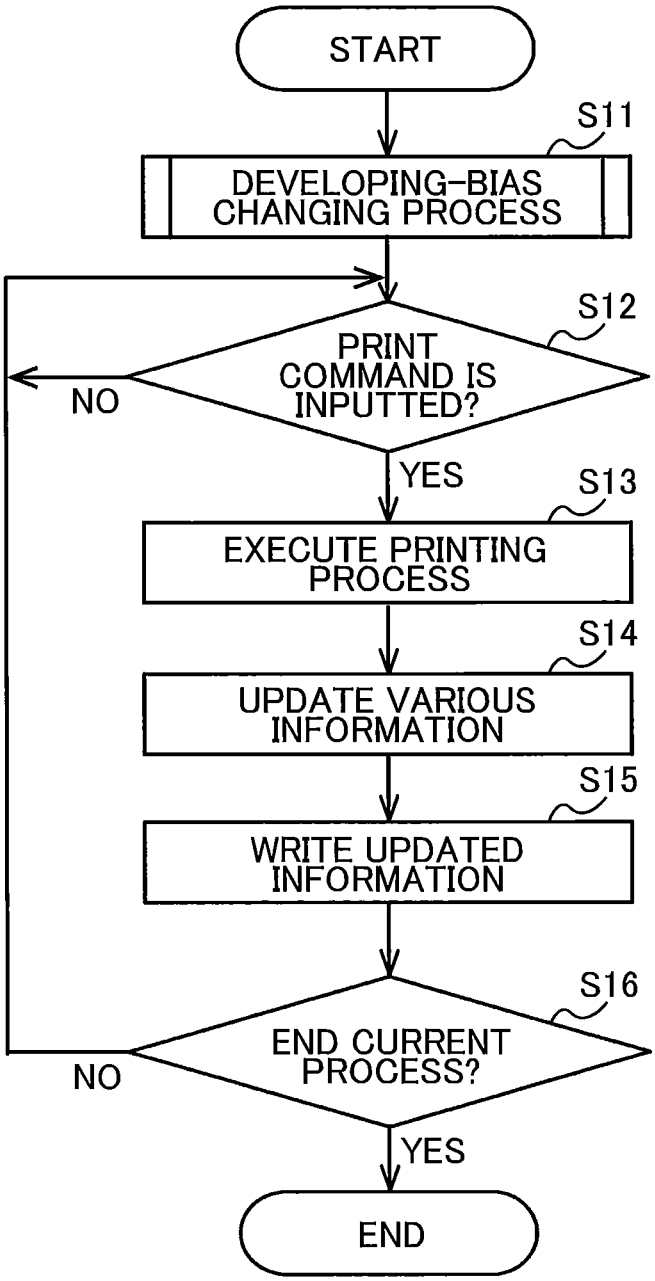
FIG. 5 is a flowchart illustrating steps in a printing process executed by the processor of the image forming apparatus according to the embodiment.

After ending the processes illustrated in FIG. 4, the processor 31 executes a printing process. FIG. 5 is a flowchart illustrating steps in the printing process.

Figure 6:
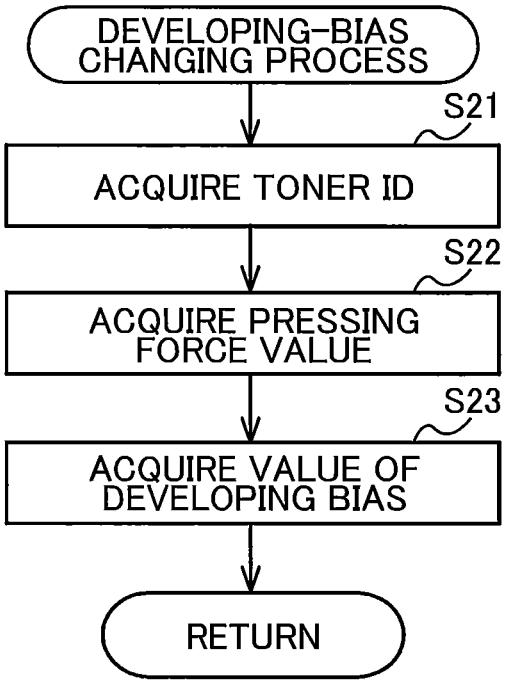
FIG. 6 is a flowchart illustrating steps in a developing-bias changing process executed by the processor of the image forming apparatus according to the embodiment.

At the beginning of the processes illustrated in FIG. 4, in S11 the processor 31 executes a developing-bias changing process. The developing-bias changing process is a process for changing a developing bias to be applied to the developing electrode 221 in accordance with a pressing force value indicating a pressing force with which the pressing member 1B presses the toner cartridge 2. FIG. 6 illustrates a flowchart illustrating steps in the developing-bias changing process.

In S21, the processor 31 acquires the toner ID included in the toner information read from the toner memory 21 in S7. For example, by using the toner ID, the processor 31 identifies the type of toner accommodated in the accommodating portion 23 of the toner cartridge 2, i.e., whether the polymerized toner or the pulverized toner is accommodated. Subsequently, in S22 the processor 31 acquires the pressing force value included in the drum information read in S2 from the drum memory 111. In S23 the processor 31 acquires a developing bias value correlated to the acquired pressing force value and the toner ID (i.e., the type of toner), and returns to the main process.

Referring back to FIG. 5, after finishing the developing-bias changing process in S11, in S12 the processor 31 determines whether the print command is inputted to the processor 31. When the processor 31 determines that a print command has not been received (S12: NO), the processor 31 waits until a print command is inputted into the processor 31. When the processor 31 determines that a print command has been inputted (S12: YES), in S13 the processor 31 executes a printing process in accordance with the inputted print command. In the printing process in S13, the voltage-applying process to apply the developing bias in accordance with the developing bias value acquired in S11 to the developing roller 22 is performed.

In S14, the processor 31 updates various information relating to the toner memory 21 and information relating to the drum memory 111. Information to be updated includes, for example, the accumulated rotation amount of the developing roller 22, the number of sheets that have been printed, and the error history stored in the toner memory 21, and the charging characteristics of each photosensitive drum 12, the accumulated rotation amount of each photosensitive drum 12, the accumulated charged time of each photosensitive drum 12, the number of sheets that have been printed, and the error history stored in the drum memory 111. Note that the information to be updated is not limited to the information indicated above, and other information may be updated where appropriate.

In S15, the processor 31 writes the updated information into the toner memory 21 and the drum memory 111. Then, in S16 the processor 31 determines whether to end the current process. For example, the processor 31 ends the process illustrated in FIG. 5 when the cover 101A is opened or when the image forming apparatus 100 is turned off. When the processor 31 determines not to end the current process (S16: NO), the processor 31 returns to S12 and repeats the processes in S12 to S15 described above. On the other hand, when the processor 31 determines to end the current process (S16: YES), the processor 31 ends the process in FIG. 5.

As described above, the image forming apparatus 100 can acquire a developing bias value corresponding to the pressing force value for the pressing member 1B of the drum cartridge 1 attached to the main body casing 101. Accordingly, even when the drum cartridge is replaced with another drum cartridge with a pressing member and a pressing force applied by the pressing member varies, the image forming apparatus 100 can apply an appropriate developing bias to the developing roller 22 of a toner cartridge 2 attached to the other drum cartridge.

In addition, the drum memory 111 stores developing biases for various types of toner, so that the image forming apparatus 100 can apply an appropriate developing bias to the developing roller 22 even when a toner cartridge 2 is replaced with another toner cartridge 2.

<4. Correction of Service Life of Toner Cartridge>

Further, the image forming apparatus 100 is configured to execute a process for correcting a service life of the toner cartridge 2 in accordance with a pressing force value for the pressing member 1B.

Figure 7:
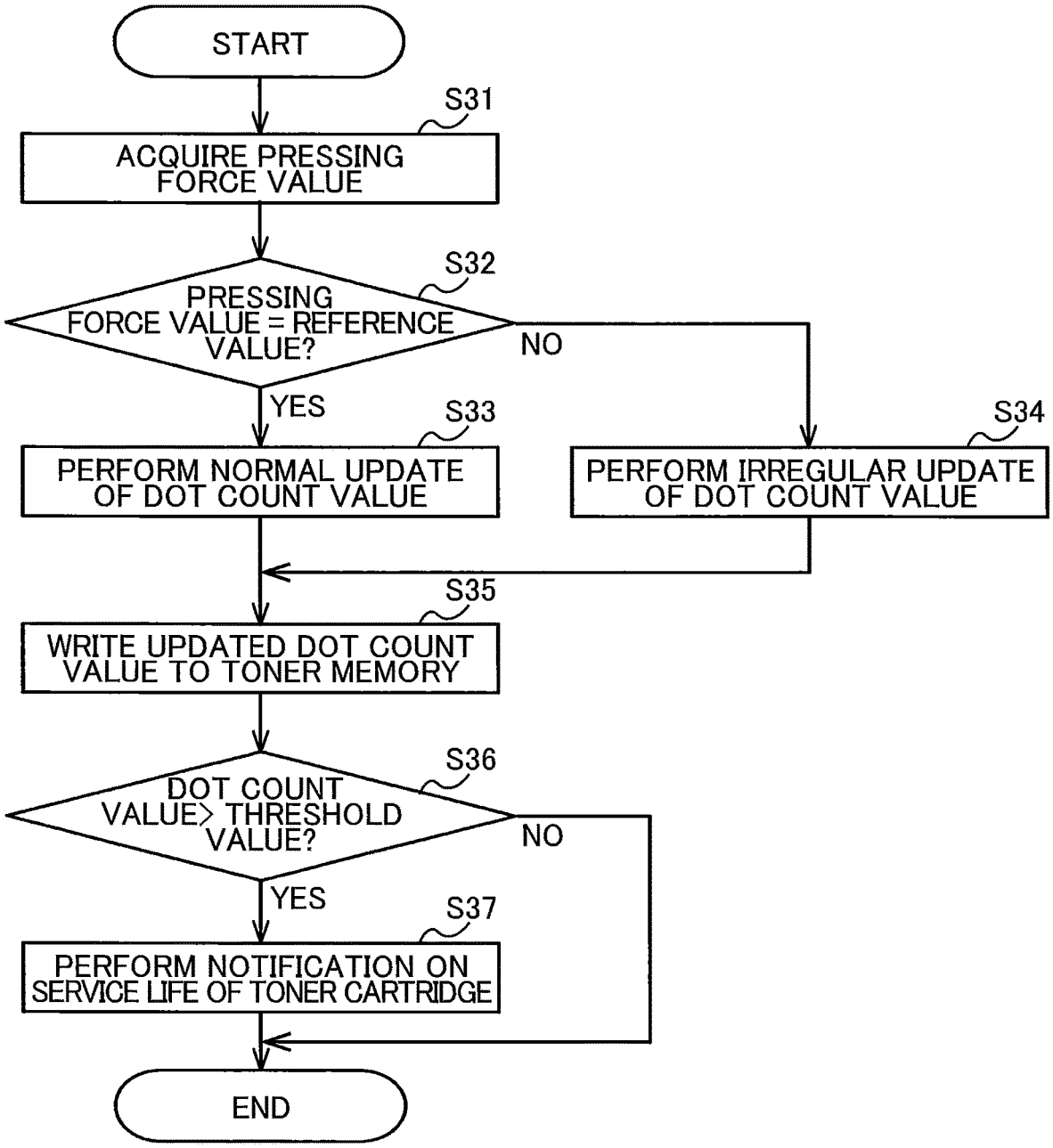
FIG. 7 is a flowchart illustrating steps in a process executed by the processor of the image forming apparatus according to the embodiment, the process being executed for correcting a service life of a toner cartridge of the image forming apparatus in accordance with the pressing force value.

FIG. 7 is a flowchart illustrating steps in a process of updating a dot count value while correcting the service life of the toner cartridge 2 in accordance with a pressing force value. The processor 31 executes processes illustrated in FIG. 7 each time the printing process is executed.

After the printing process in FIG. 5 is executed, in S31 the processor 31 acquires the pressing force value included in the drum information read from the drum memory 111 in S2. Then, in S32 the processor 31 determines whether the acquired pressing force value is coincident with a preset reference value. Note that, even when the pressing force value is not exactly coincident with the reference value in S32, the pressing force value may be deemed to be coincident with the reference value as long as an error between these the pressing force value and the reference value falls within an acceptable range.

When the processor 31 determines that the pressing force value is coincident with the reference value (S32: YES), in S33 the processor 31 performs a normal update of a dot count value (an example of a first type update). The dot count value corresponds to the number of dots included in images formed in the printing process. The processor 31 cumulatively counts the dot count value each time an image is formed. When the dot count value has exceeded a preset threshold value, the processor 31 determines that a remaining amount of toner has been decreased. Accordingly, the dot count value is an example of a value indicative of an expected service life of the toner cartridge. Further, the dot count value is also an example of a value indicative of an end-of-service of the toner cartridge. In the normal update of the dot count value in S33, the processor 31 counts the number of dots in the image formed during the printing process and updates the dot count value using the number of counted dots.

On the other hand, when the processor 31 determines that the pressing force value is not coincident with the reference value (S32: NO), in S34 the processor 31 performs an irregular update of the dot count value (an example of a second type update). Specifically, when the pressing force value is greater than the reference value or smaller than the reference value, the processor 31 determines in S32 that the pressing force value is not coincident with the reference value.

In the irregular update of the dot count value, the processor 31 corrects the service life of the toner cartridge 2 in accordance with the pressing force value. More specifically, when the pressing force value is greater than the reference value, the contact pressure between the photosensitive drum 12 and the developing roller 22 becomes large. In this case, the service life of the developing roller 22 could possibly become short. Accordingly, the processor 31 counts the dot count value at a higher rate than in the normal update. That is, the processor 31 adds the number of dots greater than the number of dots actually included in the formed image as the dot count value. Hence, the processor 31 corrects the service life of the toner cartridge 2 such that the dot count value exceeds the threshold value in a period of time shorter than usual to shorten the service life of the toner cartridge 2.

To the contrary, when the pressing force value is smaller than the reference value, the contact pressure between the photosensitive drum 12 and the developing roller 22 becomes small. In this case, it is likely that the service life of the developing roller 22 becomes long. Accordingly, the processor 31 counts the dot count value at a lower rate than in the normal update. That is, the processor 31 adds the number of dots smaller than the number of dots actually included in the formed image as the dot count value. Hence, since the dot count value exceeds the threshold value within a period of time longer than usual, the service life is corrected to extend the service life of the toner cartridge 2.

In S35, the processor 31 writes the updated dot count value to the toner memory 21. Then, in S36 the processor 31 determines whether the updated dot count value has exceeded the threshold value. When the processor 31 determines that the dot count value has exceeded the threshold value (S36: YES), in S37 the processor 31 notifies the user of information on the service life of the toner cartridge 2. Information of which the user is notified can be changed as appropriate. For example, the processor 31 may notify the user of a remaining service life of the toner cartridge 2. Alternatively, the processor 31 may notify the user that the toner cartridge 2 has come to an end of the service life. Then, the processor 31 ends the current process.

When the dot count value has not exceeded the threshold value (S36: NO), the processor 31 ends the current process without executing the process in S37. As described above, the service life of the toner cartridge 2 can be corrected in accordance with the pressing force value for the pressing member 1B.

<5. Modifications>

While the description has been made with reference to the embodiment, it would be apparent to those skilled in the art that various modifications and variations may be made thereto.

In the embodiment described above, only a developing bias is changed to adjust a potential difference between the developing bias applied to the developing roller 22 and the supply bias applied to the photosensitive drum 12. However, the supply bias may also be changed.

In the embodiment described above, the drum memory 111 stores therein the developing bias values correlated to the pressing force value of the pressing member 1B. However, the drum memory 111 may store only a pressing force value. For example, the main body memory 32 may store a pressing force value serving as a reference value and developing bias values correlated to this pressing force value.

Then, when the processor 31 acquires a pressing force value from the drum memory 111, the processor 31 calculates a ratio of the acquired pressing force value and the pressing force value serving as the reference value. In this case, the processor 31 may apply, to the developing roller 22, a developing bias that corresponds to a product of the developing bias correlated to the reference value and the calculated ratio.

Further, various features appearing in the above-described embodiment and the modifications may be suitably combined together avoiding conflicting combination.

What is claimed is:

1. An image forming apparatus comprising:

a casing;

a toner cartridge including:

a developing roller having an outer circumferential surface; and a developing electrode electrically connected to the developing roller;

a drum cartridge to which the toner cartridge is attachable, the drum cartridge being attachable to the casing in a state where the toner cartridge is attached to the drum cartridge, the drum cartridge including:

a photosensitive drum having an outer circumferential surface;

a pressing member configured to press the toner cartridge toward the photosensitive drum with a pressing force in the state where the toner cartridge is attached to the drum cartridge so that the outer circumferential surface of the developing roller is in contact with the outer circumferential surface of the photosensitive drum; and a drum memory storing therein information representing a pressing force value, the pressing force value being a value indicative of the pressing force to be applied by the pressing member;

a main electrode electrically connected to the developing electrode in a state where the drum cartridge to which the toner cartridge is attached is attached to the casing;

a first reading portion electrically connected to the drum memory in the state where the drum cartridge to which the toner cartridge is attached is attached to the casing, the information stored in the drum memory being read from the drum memory through the first reading portion; and a controller configured to perform:

(a) reading, through the first reading portion, the pressing force value from the drum memory; and (b) applying a voltage to the main electrode based on the pressing force value read in the (a) reading.

2. The image forming apparatus according to claim 1, wherein the drum memory further stores therein a developing bias value, the developing bias value being a value indicative of the voltage to be applied to the main electrode, the developing bias value being associated with the pressing force value, wherein the (a) reading reads the developing bias value from the drum memory together with the pressing force value, and wherein the (b) applying applies the voltage to the main electrode in accordance with the developing bias value read in the (a) reading.

3. The image forming apparatus according to claim 1, wherein the toner cartridge further includes a toner memory storing therein toner information, the toner information being information related to the toner cartridge, the image forming apparatus further comprising a second reading portion electrically connected to the toner memory in the state where the drum cartridge to which the toner cartridge is attached is attached to the casing, the toner information stored in the toner memory being read from the toner memory through the second reading portion, wherein the (a) reading reads, through the second reading portion, the toner information from the toner memory.

4. The image forming apparatus according to claim 3, wherein the toner cartridge further includes an accommodating portion accommodating toner therein, wherein the toner information includes identification information used to identify the toner cartridge, wherein the (a) reading reads the toner information including the identification information from the toner memory, and wherein the (b) applying applies the voltage to the main electrode based on the identification information read in the (a) reading.

5. The image forming apparatus according to claim 4, wherein the drum memory further stores therein the developing bias value, the developing bias value being a value indicative of the voltage to be applied to the main electrode, the developing bias value being associated with both the pressing force value and the identification information, wherein the (a) reading reads the developing bias value from the drum memory together with the pressing force value and reads the identification information from the toner memory, and wherein the (b) applying applies the voltage to the main electrode in accordance with the developing bias value read in the (a) reading.

6. The image forming apparatus according to claim 3, wherein the toner information includes a value indicative of an expected service life of the toner cartridge, and wherein the controller is configured to further perform:

(c) correcting the value indicative of the expected service life of the toner cartridge based on the pressing force value read in the (a) reading.

7. The image forming apparatus according to claim 6, wherein the value indicative of the expected service life of the toner cartridge is a dot count value, the dot count value being a value indicative of the number of dots included in an image formed using toner accommodated in the accommodating portion, and wherein the (c) correcting corrects the dot count value based on the pressing force value read in the (a) reading.

8. The image forming apparatus according to claim 7, wherein the (c) correcting includes:

(c1) determining whether the pressing force value read in the (a) reading is coincident with a preset reference value;

in response to the (c1) determining determining that the pressing force value read in the (a) reading is coincident with the preset reference value, (c2) performing a first type update of the dot count value in which the number of dots included in the image actually formed is cumulatively added each time a printing process is performed; and in response to the (c1) determining determining that the pressing force value read in the (a) reading is smaller than the preset reference value, (c3) performing a second type update of the dot count value in which the number of dots smaller than the number of dots included in the image actually formed is cumulatively added each time the printing process is performed.

9. The image forming apparatus according to claim 7, wherein the (c) correcting includes:

(c1) determining whether the pressing force value read in the (a) reading is coincident with a preset reference value;

in response to the (c1) determining determining that the pressing force value read in the (a) reading is coincident with the preset reference value, (c2) performing a first type update of the dot count value in which the number of dots included in the image actually formed is cumulatively added each time a printing process is performed; and in response to the (c1) determining determining that the pressing force value read in the (a) reading is greater than the preset reference value, (c3) performing a second type update of the dot count value in which the number of dots greater than the number of dots included in the image actually formed is cumulatively added each time the printing process is performed.

10. The image forming apparatus according to claim 1, wherein the toner cartridge further includes an accommodating portion accommodating toner therein, wherein the drum cartridge to which the toner cartridge is attached is attached to the casing, and wherein the voltage applied in the (b) applying is a force-dependent bias voltage, the force-dependent bias voltage being dependent upon the pressing force value read in the (a) reading.

11. The image forming apparatus according to claim 10, wherein the drum memory further stores therein a force-dependent bias voltage value determined depending upon the pressing force value, wherein the (a) reading reads the force-dependent bias voltage value stored in the drum memory together with the pressing force value, and wherein the (b) applying applies the force-dependent bias voltage in accordance with the force-dependent bias voltage value read in the (a) reading to the main electrode.

12. The image forming apparatus according to claim 10, wherein the toner cartridge further includes a toner memory storing therein toner information about the toner cartridge, the image forming apparatus further comprising a second reading portion capable of accessing to the toner memory for reading the toner information stored in the toner memory, wherein the (a) reading reads, through the second reading portion, the toner information from the toner memory.

13. The image forming apparatus according to claim 12, wherein the toner information includes identification information used to identify the toner cartridge, wherein the (a) reading reads the toner information including the identification information from the toner memory, and wherein the force-dependent bias voltage to be applied to the main electrode in the (b) applying is further determined depending upon the identification information read in the (a) reading.

14. The image forming apparatus according to claim 13, wherein the drum memory further stores therein a force-dependent bias voltage value in relation not only to the pressing force value but also to the identification information, wherein the (a) reading reads the force-dependent bias voltage value from the drum memory together with the related pressing force value and reads the identification information from the toner memory, and wherein the (b) applying applies the force-dependent bias voltage to the main electrode in accordance with the force-dependent bias voltage value read in the (a) reading.

15. The image forming apparatus according to claim 12, wherein the toner information includes a value indicative of an end-of-service of the toner cartridge, and wherein the controller is configured to further perform:

(c) correcting the value indicative of the end-of-service of the toner cartridge based on the pressing force value read in the (a) reading.

16. The image forming apparatus according to claim 15, wherein the value indicative of the end-of-service of the toner cartridge is a dot count value, the dot count value being a value indicative of the number of dots included in an image formed using toner accommodated in the accommodating portion, and wherein the (c) correcting corrects the dot count value based on the pressing force value read in the (a) reading.

17. The image forming apparatus according to claim 16, wherein the (c) correcting includes:

(c1) determining whether the pressing force value read in the (a) reading is coincident with a preset reference value;

in response to the (c1) determining determining that the pressing force value read in the (a) reading is coincident with the preset reference value, (c2) performing a first type update of the dot count value in which the number of dots included in the image actually formed is cumulatively added each time a printing process is performed; and in response to the (c1) determining determining that the pressing force value read in the (a) reading is smaller than the preset reference value, (c3) performing a second type update of the dot count value in which the number of dots smaller than the number of dots included in the image actually formed is cumulatively added each time the printing process is performed.

18. The image forming apparatus according to claim 16, wherein the (c) correcting includes:

(c1) determining whether the pressing force value read in the (a) reading is coincident with a preset reference value;

in response to the (c1) determining determining that the pressing force value read in the (a) reading is coincident with the preset reference value, (c2) performing a first type update of the dot count value in which the number of dots included in the image actually formed is cumulatively added each time a printing process is performed; and in response to the (c1) determining determining that the pressing force value read in the (a) reading is greater than the preset reference value, (c3) performing a second type update of the dot count value in which the number of dots greater than the number of dots included in the image actually formed is cumulatively added each time the printing process is performed.

* * * * *